US006361137B1

(12) United States Patent
Eaton et al.

(10) Patent No.: US 6,361,137 B1
(45) Date of Patent: Mar. 26, 2002

(54) METHOD AND APPARATUS FOR COMPENSATING FOR VARIATIONS IN PRINTHEAD-TO-MEDIA SPACING AND PRINTHEAD SCANNING VELOCITY IN AN INK-JET HARD COPY APPARATUS

(75) Inventors: John T. Eaton, Vancouver; Jason Quintana, Brush Prairie., both of WA (US); Carl Eric Thomsen, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/162,369

(22) Filed: Sep. 28, 1998

(51) Int. Cl.[7] ..... B41J 29/38
(52) U.S. Cl. ..... 347/14
(58) Field of Search ..... 347/14, 19, 37, 347/8

(56) References Cited

U.S. PATENT DOCUMENTS

| | | | | |
|---|---|---|---|---|
| 4,524,364 A | | 6/1985 | Bain et al. | 347/39 |
| 4,786,803 A | | 11/1988 | Majette et al. | 250/237 |
| 4,789,874 A | | 12/1988 | Majette et al. | 346/140 |
| 5,170,047 A | * | 12/1992 | Beauchamp et al. | 346/25 |
| 5,262,797 A | | 11/1993 | Boeller et al. | 346/1.1 |
| 5,289,208 A | | 2/1994 | Haselby | 346/140 |
| 5,414,453 A | | 5/1995 | Rhoads et al. | 347/8 |
| 5,448,269 A | | 9/1995 | Beauchamp et al. | 347/19 |
| 5,926,192 A | * | 7/1999 | Yamane | 347/37 |
| 5,988,784 A | * | 11/1999 | Takemura et al. | 347/8 |
| 6,161,914 A | * | 12/2000 | Haselby | 347/19 |

FOREIGN PATENT DOCUMENTS

| | | |
|---|---|---|
| EP | 0040313 A | 11/1981 |
| EP | 0622220 A | 11/1994 |

* cited by examiner

*Primary Examiner*—John Barlow
*Assistant Examiner*—Julian D. Huffman

(57) ABSTRACT

The present invention provides a method for compensating for the velocity variation in an ink-jet pen by dynamically varying the ink drop firing timing as a function of pen velocity. This makes it possible to print while the pen is accelerating or decelerating without affecting image quality. Scanning velocity change compensation is dynamically and continuously updated at a rate equal to or greater than an encoder edge rate. Further, the present invention provides a method for improving ink drop positioning accuracy across a print media scan by compensating for the change in ink-drop flight time as printhead-to-paper distance changes. Ink drop flight time error is dynamically compensated such that a fired droplet of ink hits its intended target pixel without any appreciable error.

12 Claims, 9 Drawing Sheets

METHOD AND APPARATUS FOR COMPENSATING FOR VARIATIONS IN PRINTHEAD-TO-MEDIA SPACING AND PRINTHEAD SCANNING VELOCITY IN AN INK-JET HARD COPY APPARATUS

RELATED APPLICATIONS

This application is related to U.S. patent application Ser. No. 09/161,798 entitled "Apparatus And Method For Correcting Carriage Velocity Induced Ink Drop Positional Errors," filed concurrently herewith this application on Sep. 28, 1998.

BACKGROUND OF THE INVENTION

1. Field of the Invention

The present invention relates to ink-jet hard copy apparatus and, more particularly, to the art of generating control signals for firing ink droplets from a scanning ink-jet printhead and, specifically to methods and apparatus for compensating for variations in printhead-to-media spacing and printhead scanning velocity.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988).

FIG. 1 depicts an ink-jet hard copy apparatus, in this exemplary embodiment a computer peripheral printer, 101. A housing 103 encloses the electrical and mechanical operating mechanisms of the printer 101. Operation is administrated by an electronic controller (usually a microprocessor-controlled printed circuit board, not shown) connected by appropriate cabling to a computer (not shown). Cut-sheet print media 105, loaded by the end-user onto an input tray 107, is fed by a suitable paper-path transport mechanism (not shown) to an internal printing station where graphical images or alphanumeric text is created. A carriage 109, mounted on a slider 111, scans the print medium. An encoder strip 113 and appurtenant devices (not shown) are provided for keeping track of the position of the carriage 109 at any given time. The fundamentals of encoder tracking are set out in U.S. Pat. Nos. 4,786,803 and 4,789,874 (Majette, et al.) (assigned to the common assignee hereof and incorporated herein by reference in their entireties). A set 115 of ink-jet pens, or print cartridges, 117A–117D are releasable mounted in the carriage 109 for easy access. In pen-type hard copy apparatus, separate, replaceable or refillable, ink reservoirs (not shown) are located within the housing 103 and appropriately coupled to the pen set 115 via ink conduits (not shown). Once a printed page is completed, the print medium is ejected onto an output tray 119.

An ink-jet pen includes a printhead which consists of a number of columns of ink nozzles. The columns of nozzles fire ink droplets that are used to create a print column of dots on an adjacently positioned print media as the pen is scanned across the media. A given nozzle of the printhead is used to address a given vertical column position, referred to as a picture element, or "pixel," on the print media. Horizontal positions on the print media are addressed by repeatedly firing a given nozzle as the pen is scanned. Thus, a single sweep scan of the pen can print a swath of dots. The print media is stepped to permit a series of scans. Dot matrix manipulation is used to form alphanumeric characters, graphical images, and even photographic reproductions from the ink drops. Generally, the pen scanning axis is referred to as the x-axis, the print media transport axis is referred to as the y-axis, and the ink drop firing direction is referred to as the z-axis.

Note that when a nozzle is fired, the ink is ejected from the pen at a finite velocity and it must travel a finite distance along the z-axis between the pen and the print media (for convenience and without limitation to the scope of the invention, the word "paper" will be used hereinafter to mean any form of print media). Since the pen is not stopped at each position during scanning in the x-axis, a fired ink droplet will also have a velocity in the x-axis direction as it traverses the distance to the paper surface. Thus, in order to hit a target pixel, any given nozzle should be fired a finite time before the pen positions the nozzle directly over the location where the dot is intended to be printed. However, in the art it is often generally assumed that all drops will have the same offset and thus, without such time of drop firing compensation, overall print quality is not affected even though the image is shifted as a whole. If at all compensated, an average advanced time of the firing signal is calculated by using the expected flight time of the drop and the current pen velocity, each of which is known from the design of a specific implementation of ink-jet hard copy apparatus (e.g., it is known that the maximum allowable carriage speed without print quality degradation is calculated by taking the time it takes for pen control logic circuitry to shift one set of data up to the pen and fire divided by the pen nozzle stagger distance (explained hereinbelow); the flight time is calculated by dividing the nozzle-to-paper spacing by the velocity of the ink drop.

A typical prior art drop firing encoder is shown in FIG. 1A with a timing diagram therefor shown in FIG. 1B. An encoder 113 provides two output timing signals, "EncA" and "EncB," which are decoded 121 as fundamental coarse position indicators of where the carriage 109 is during a scan. The leading and trailing edge of each encoder signal can thus be used in conjunction with a counter 122 to generate carriage position, tracking carriage movement in units such as 1/150th inch (this value will be used throughout as an exemplary embodiment herein; no limitation on the scope of the invention is intended thereby nor should any be inferred therefrom). A series of fire timing pulses, "FTP"_COUNT, is generated for each position signal, allowing the FIRE pulse actually to trigger firing of a plurality of nozzles in the printhead. Fire timing pulses are generated continuously by a clock during normal printing and used in accordance with the number of nozzles arrays in a particular printhead design as needed. The Fire Position circuitry 123 combines the position information with a value for a nozzle firing register 123 to generate a nozzle firing pulse, "FIRE," e.g., every period comprising movement of the carriage 1/150th inch. The leading or trailing edge is also used in a Period_Counter 124 to determine the carriage velocity. Dividing 125 the period by a predetermined number (e.g., 100, taken from an extrapolation_division register (not shown)—a value related to the number of nozzle firing desired per period for a particular printhead implementation, the FTP_COUNT pulses) provides an extrapolation for the timing of the FTP_COUNT pulses. That is, an extrapolator latch 126_counter 127 takes the measurement of the carriage period as measured in clock cycles divided by the value kept in the extrapolation-division register. The FTP_COUNT pulses are also provided 128 as fine position indicator for carriage position.

However, the horizontal distance from the actual advanced firing position of a given nozzle to where the drop actually lands is dependent on the scanning velocity of the pen. Knowing the total flight time of the ink drop and the pen scan velocity, the distance can be calculated by multiplying these two values. If the scan velocity of the pen is constant, the amount by which the firing signal precedes each pixel position is a constant. As discussed above, in this case the whole printed image is just shifted by a constant amount; that is, the image is moved by the number of dot positions that equal the over-shoot distance. Compensation in the foregoing manner moves the whole rendered image to attempt to compensate simply for this error. However, this does methodology does nothing to improve instantaneous drop placement accuracy within each scan swath.

In fact, when a pen is scanned across the paper, its velocity is not constant. Also, there are pen acceleration and deceleration ramps at each end of a scan which may still be within the intended printing zone on the paper. Firing nozzles during such changing pen velocity causes successive ink drops to land at varying distances from the intended uniform spacing. Furthermore, in order to increase throughput and to improve print quality by using print modes such as checkerboarding the printed pixels' dot matrix pattern on the paper, bi-directional printing is often the preferred print mode. Note also that bi-directional scanning prints pixels in opposite time-of-firing directions, further complicating the pixel alignment. In other words, a trade-off must be made between throughput and image quality in accordance with deciding when to fire ink drops using current fire pulse timing solutions.

Another solution is to make the sweep width wider than the printed area so as not to print on the acceleration and deceleration ramps of a scan but only during supposed constant pen velocity periods; this causes both a throughput penalty and requirement for a larger apparatus workspace footprint.

Moreover, a further problem exists when the nozzle-to-paper spacing is not a constant. The variation in this nozzle-to-paper spacing causes the drop positioning to change non-uniformly across the width of the scan. Therefore, drop positioning will change across the page, causing drops not to hit the intended address pixel grid correctly. Thus, there is a need to calculate the firing advance dynamically to remove positioning errors which would result from changes in the nozzle-to-paper spacing during any one scan.

A further time-of-firing complication is added when a vertical column of nozzles on the printhead is broken into groups, called "primitives," generally for use with different color inks being fired from a single printhead. In order to prevent having to fire all nozzles simultaneously, within a column and within a primitive, the nozzles are staggered horizontally in the pen scan x-axis direction by an amount slightly less than the space between print columns divided by the number of nozzles per primitive. This means that the firing from one nozzle to the next occurs at a defined spacing, known as the "stagger distance," (or simply "stagger") which is less than the spacing between dots on the media. The carriage must move this stagger distance between firing different nozzles of the same column (e.g., stagger time is calculated taking the time it takes the carriage to traverse the 1/150th inch and dividing this time by the number of stagger distances in that 1/150th inch). In this manner, the nozzles of each primitive can fire sequentially to create a vertical column of dots on the paper.

In order to solve these problems, there is a need for dynamically varying the ink drop fire timing as a function of pen velocity. Note that this compensation for flight time assumes pen-to-paper spacing is constant and a static flight-time value can be used when performing pen velocity compensation, while at the same time, the variation in this spacing causes the drop positioning to change across the width of the paper since the pen velocity compensation is being performed statically when a dynamic flight-time may be needed. Thus, there is a need for compensation of both factors in order to deposit ink droplets accurately on intended target pixels.

SUMMARY OF THE INVENTION

In its basic aspects, the present invention provides an ink drop fire timing control device for an ink-jet hard copy mechanism for producing dot matrix printing on print media, the hard copy mechanism including an ink-jet pen and a carriage for scanning the pen across print media along a linear axis. The device includes comprising: a mechanism for generating periodic carriage position signals as the carriage is scanning the pen across print media along a linear axis; a mechanism for producing ink drop fire timing signals based upon the periodic carriage position signals; and a flight compensation mechanism for extrapolating a value representative of expected ink drop flight time error from the pen to the print media and advancing the ink drop fire timing signals to compensate for the expected ink drop flight time error such that ink drop flight time is compensated for velocity changes of the carriage as the carriage traverses the linear axis, wherein scanning position interrupt signals are generated by comparing carriage position with a next predetermined interrupt position.

In another basic aspect, the present invention provides an ink drop fire timing control device for an ink-jet hard copy mechanism for producing dot matrix printing on print media, the hard copy mechanism including an ink-jet pen, a carriage for scanning the pen across print media along a linear axis, and mechanism for generating periodic carriage position signals representative of periodic predetermined pen scanning positions along the axis as the carriage is scanning the pen across print media along a linear axis. The timing control device includes: paper shape compensation mechanism for generating a value representative of expected flight time for each of the periodic predetermined pen scanning positions along the axis calculated from a predetermined paper shape profile; and a mechanism for adjusting ink drop fire timing based on the value representative of expected flight time such that ink drops are ejected from the pen before the carriage positions the pen at a position for firing based on the signals representative of periodic predetermined pen scanning positions along the axis.

In another basic aspect, the present invention provides an ink drop fire timing control method for an ink-jet hard copy mechanism for producing dot matrix printing on target pixels of a print media, the hard copy mechanism including an ink-jet pen having a printhead with a plurality of ink drop firing nozzles arrayed as a staggered vertical column, a carriage for scanning the pen across print media along a linear horizontal axis, and mechanism for generating periodic carriage position signals representative of periodic predetermined pen scanning positions along the axis as the carriage is scanning the pen across print media along a linear axis. The method includes the steps of:

providing a signal indicative of coarse position of the carriage during scanning;

from the indicative of coarse position, deriving a periodic ink drop firing time signal;

from the signal indicative of coarse position, extrapolating a signal indicative of fine position of the carriage during scanning, the fine position being a predetermined subdivision of the coarse position by a number equal to the plurality of ink drop firing nozzles;

providing a signal indicative of expected flight time of a drop from the printhead to the print media;

from the signal indicative of fine position and the signal indicative of expected flight time, deriving a flight time error signal; and from the flight time error signal, advancing the periodic ink drop firing time signal such that ink drops are fired before the carriage is positioned over a target pixel.

The step of providing a signal indicative of expected flight time of a drop from the printhead to the print media includes the steps of:

programming a paper profile value for each the fine position; and incrementing the expected flight time when the profile value indicates pen-to-paper spacing is increasing at a fine position along the axis and decrementing the expected flight time when the profile value indicates pen-to-paper spacing is decreasing at a fine position along the axis.

In still another basic aspect, the present invention provides an ink-jet paper shape compensation device for generating a value representative of expected flight time for each of the periodic predetermined pen scanning positions along the axis. The paper shape compensation device includes: a re-loadable down counter mechanism for counting at each of the periodic predetermined pen scanning positions along the axis; and connected to the counter mechanism, mechanism for changing the value representative of expected flight time such that the value representative of expected flight time is incremented when pen-to-paper spacing is increasing and decremented when pen-to-paper spacing is decreasing at each of the periodic predetermined pen scanning positions along the axis.

It is an advantage of the present invention that it improves the ink drop positioning accuracy across a print medium scan by compensating for the change in ink drop flight time during velocity fluctuations and during carriage velocity ramps.

It is an advantage of the present invention that it allows ink drop flight time changes to be implemented as a simple, adjustable, incrementer/decrementer circuit.

It is an advantage of the present invention that it provides compensation for the change in ink drop flight time during variations of printhead-to-paper distance across a print medium scan.

It is another advantage of the present invention that it provides printhead-to-paper distance variation and scanning velocity variation compensation for bi-directional ink-jet printing.

It is still a further advantage of the present invention that it automatically compensates during carriage acceleration and deceleration velocity ramps, allowing a wider print zone than constant velocity printing modes.

It is yet a further advantage of the present invention that accurate printing during velocity ramps allows a narrower carriage travel and permits a smaller workplace footprint for a hard copy apparatus.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. Subtitles provided herein are for the convenience of the reader; no limitation on the scope of the invention is intended thereby nor should any be inferred therefrom.

General Operation

Figure 2:
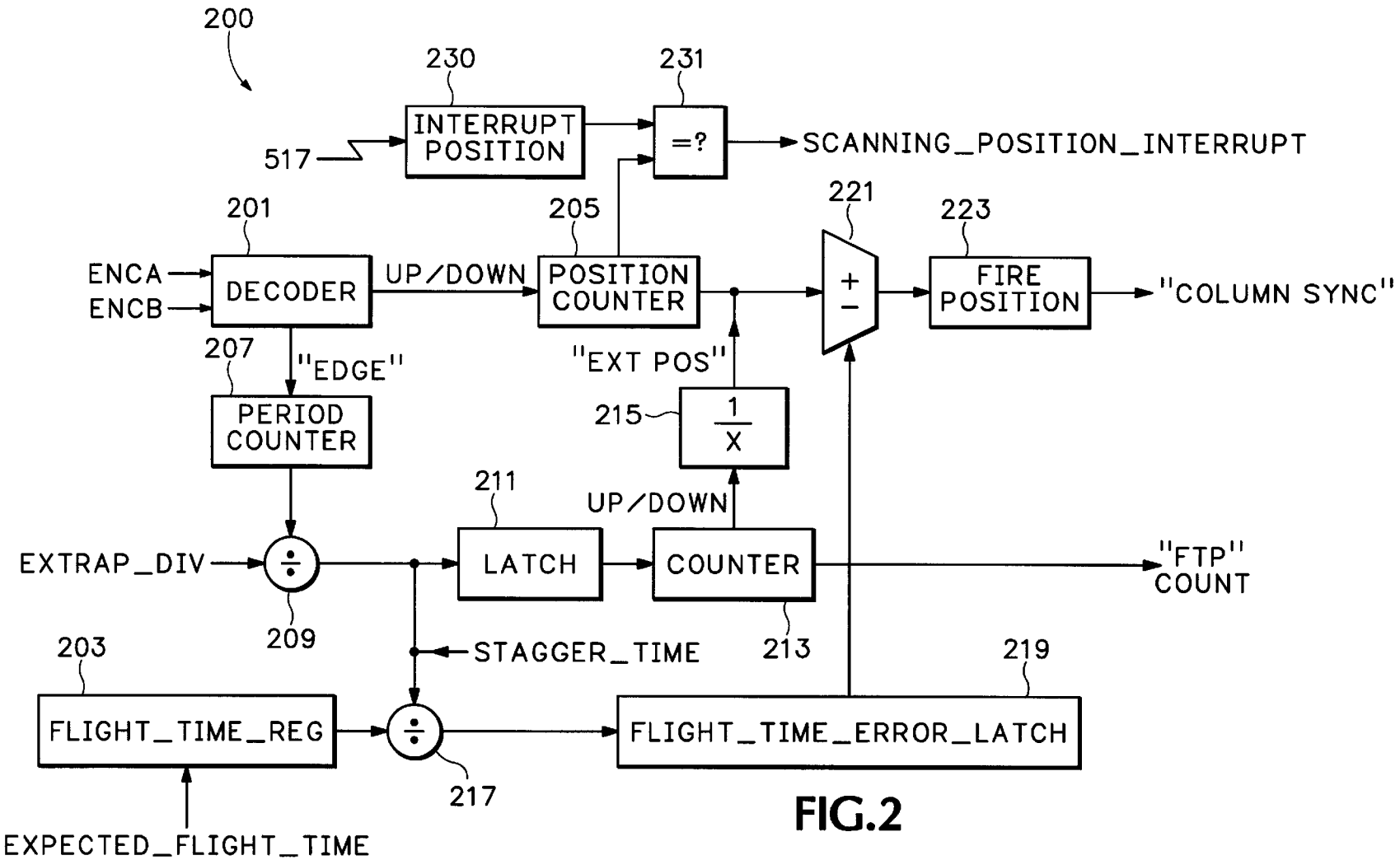
FIG. 2 is a circuit block diagram for x-axis, ink-jet carriage velocity compensation in accordance with the present invention.

The present invention uses combinatorial and sequential logic as shown in FIG. 2, referred to generically hereinafter as the Velocity Compensator 200, to vary the timing of fire pulses to compensate for variation in the x-axis velocity in a nozzle firing timing circuit. An accompanying timing waveform diagram is provided in FIG. 3 in which:

EncA is a first encoder output;

EncB is a second encoder output;

Position is a counter output based on EncB/EncA;

Edge is the pulse generated from decoding EncB with EncA in the same state;

ExtPos is the extrapolated pulse train derived from EncA and EncB;

FTP is the fire timing pulse train; and

ColumnSync is the extrapolated firing pulse including a derived flight time error.

Figure 1:
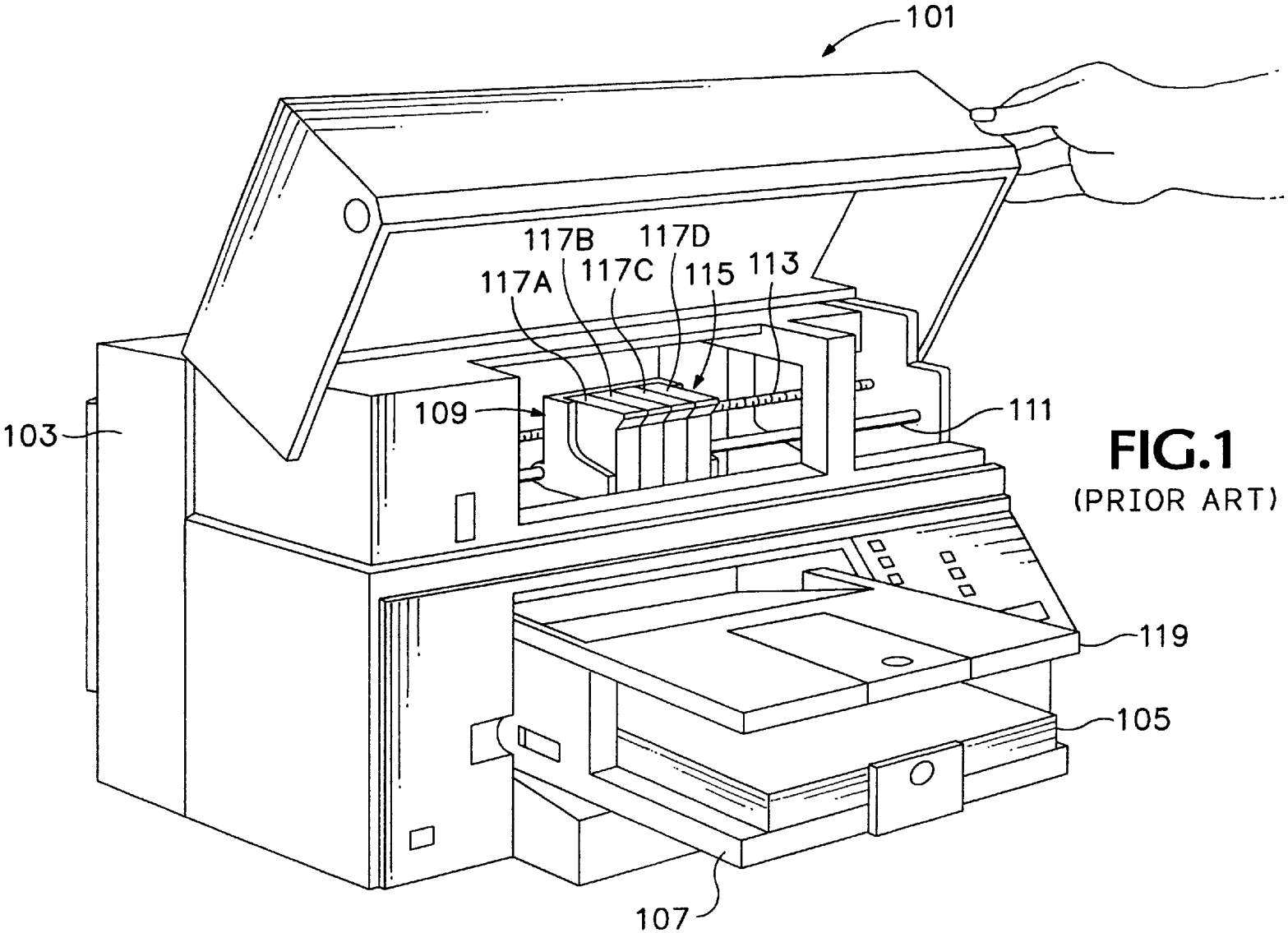
FIG.1 (PRIOR ART)
FIG. 1 (Prior Art) is a perspective view rendering of an ink-jet hard copy apparatus.
Figure 4:
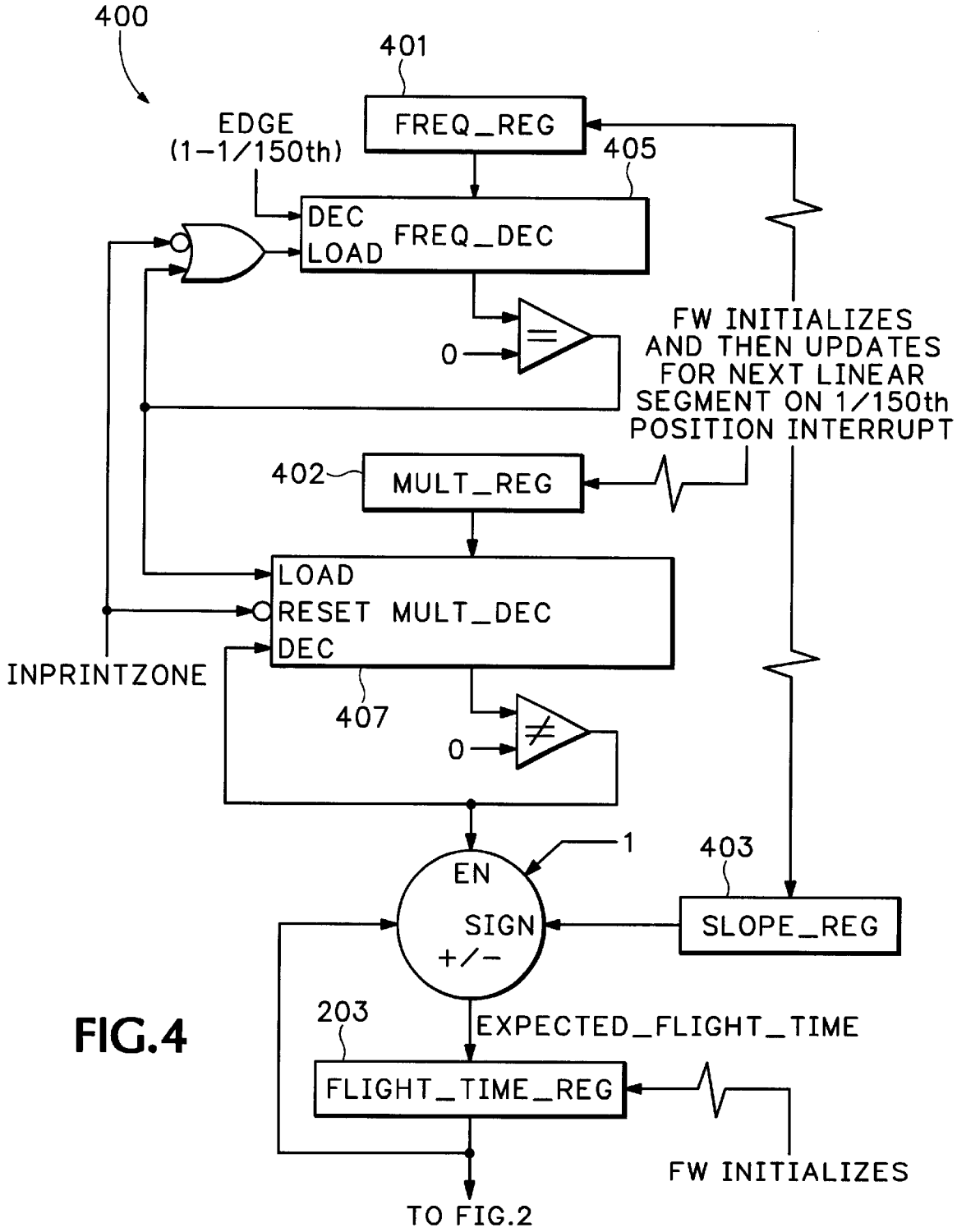
FIG. 4 is a circuit block diagram for z-axis, printhead-to-paper distance variation compensation in accordance with the present invention, providing input to the circuit of FIG. 2.

Keeping FIG. 1 at hand, the encoder strip 113 is used to generate a series of pulses, EncA and EncB, as the carriage 109 translates back-and-forth along the x-axis. Normally in the prior art, such as taught by Majette et al. in U.S. Pat. No. 4,789,874, the encoder signal will be used to generate nozzle firing signals that occur when the carriage 109 has reached a desired position. In the present invention, use of a FLIGHT_TIME_REGISTER 203 compensation enables the production of firing signals at a programmable time before the carriage 109 reaches the target position to compensate for the time that it takes a fired ink drop to reach the print medium and the x-axis velocity imparted to a fired ink drop by the carriage 109. An apt analogy would be the dropping of a free-fall bomb prior to the airplane actually being directly over the target. While an EXPECTED_FLIGHT_TIME ("EFT" hereinafter) as measured in system clock cycles could be used as the input signal, in order to compensate for paper shape changes, the input is dynamically derived in a Paper Shape Compensator 400 as shown in FIG. 4, with the methodology of operation shown in FIG. 5.

Paper Shape Compensation

Figure 6:
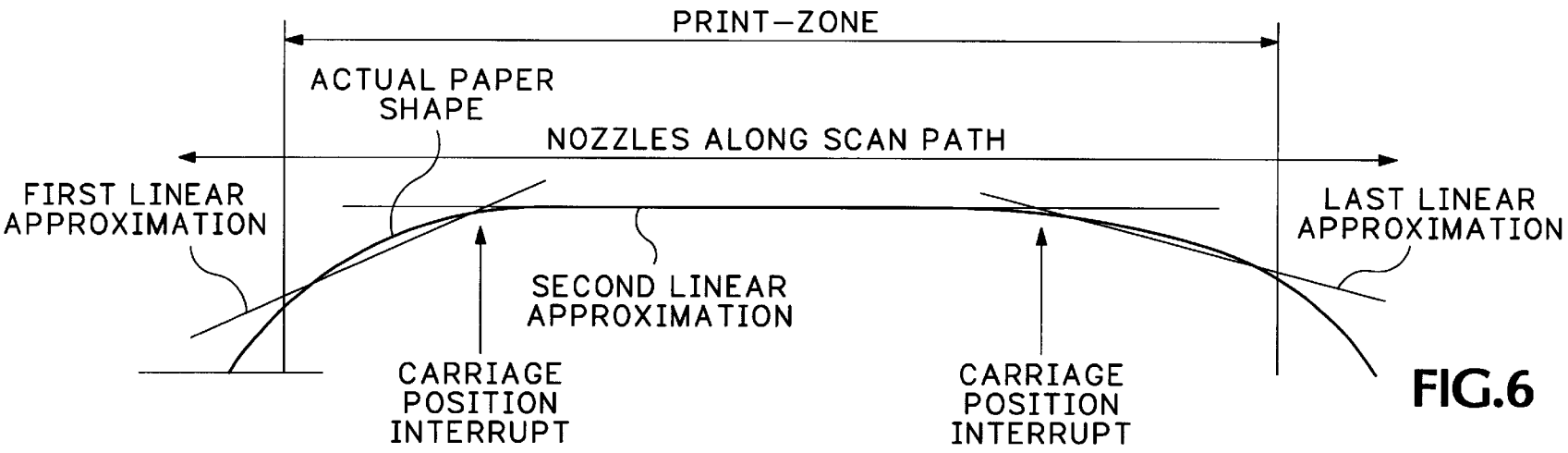
FIG. 6 is a schematic depiction of paper shape, discrete linear approximation, correction method as used in the z-axis compensation of FIGS. 4 and 5.

A piecewise linear approximation to actual paper shape is generated as schematically depicted in FIG. 6, where the view is looking into the printer along the y-axis. The paper shape compensator 400 is implemented by using the minimum time unit used to describe ink drop flight time. In general, a flight time change can be implemented as a simple, programmable incrementer/decrementer. The circuitry that determines if the flight time is updated is implemented by using a simple re-loadable, down counter that counts down at each decision interval, viz. the time it takes the carriage to move 1/150th inch in this exemplary embodiment. When the counter counts down to zero, the flight time is either incremented or decremented and the counter is re-loaded with the programmable value. The programmable value correlates to the rate at which the pen to paper spacing is changing. The flight time is incremented if the spacing is increasing and is decremented if the spacing is decreasing. The profile is generated as a piecewise linear approximation of actual contouring of a sheet of media on the printing station platen of the hard copy apparatus.

Figure 3:
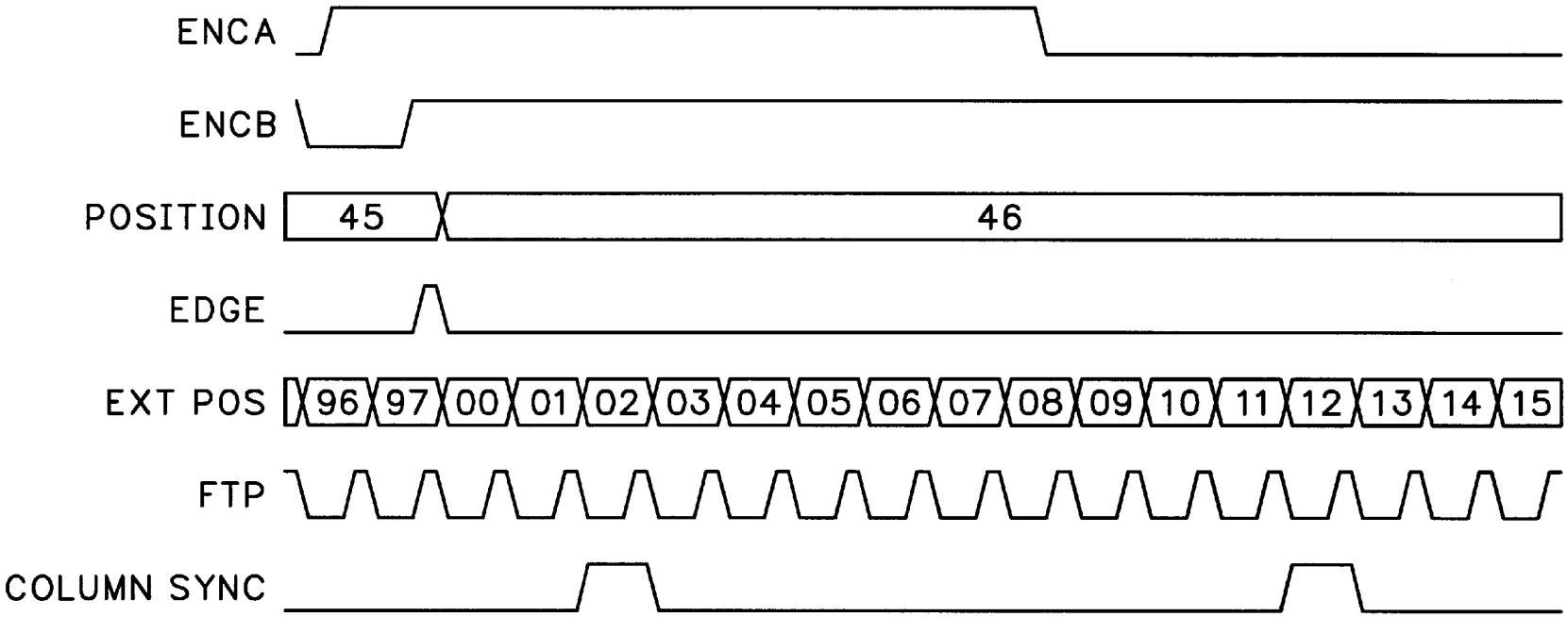
FIG. 3 is a timing waveform diagram for the circuit shown in FIG. 2.
Figure 5A:
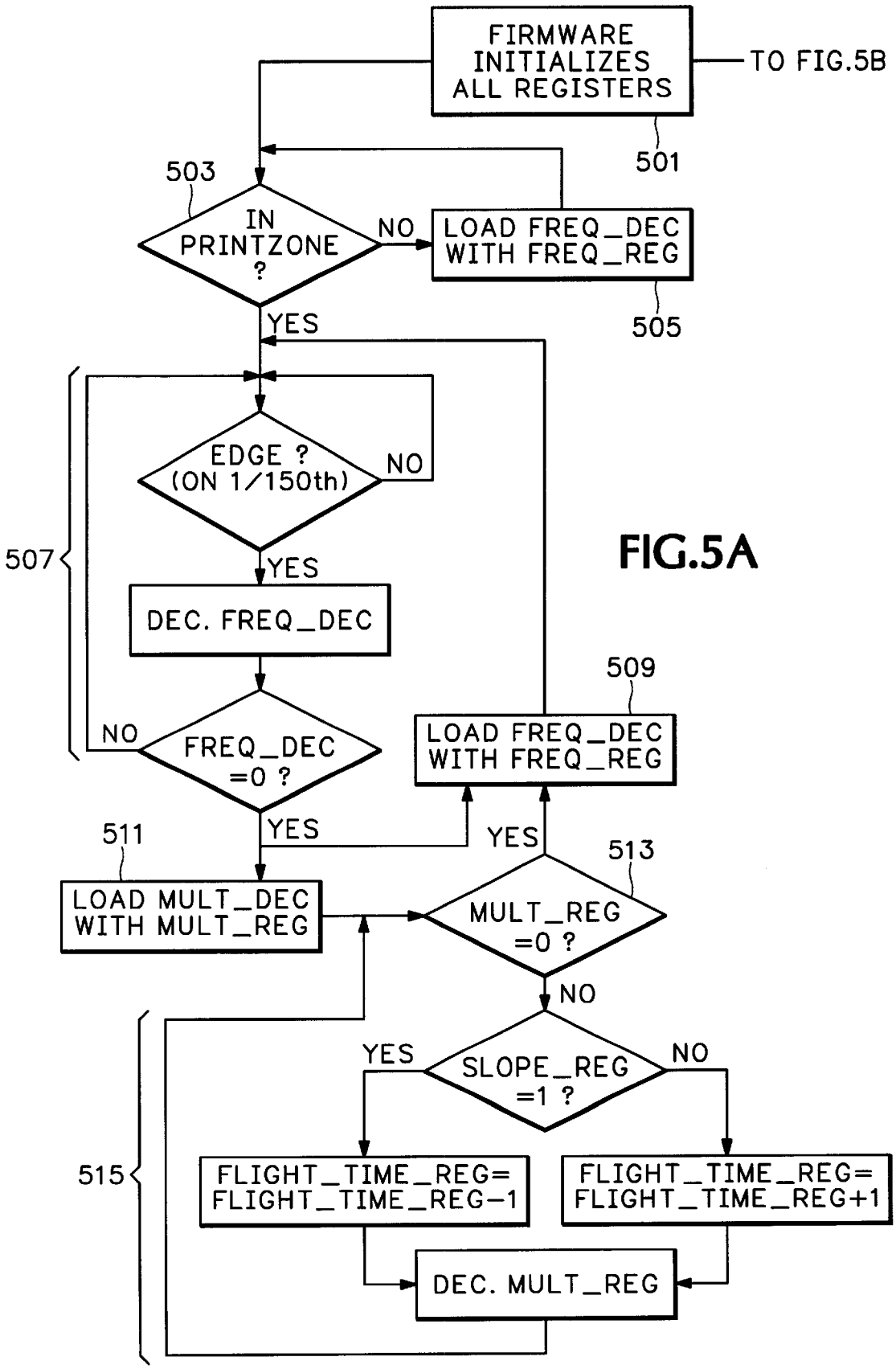
FIG. 5 is a flow chart for the circuit block diagram shown in FIG. 4.
Figure 5B:
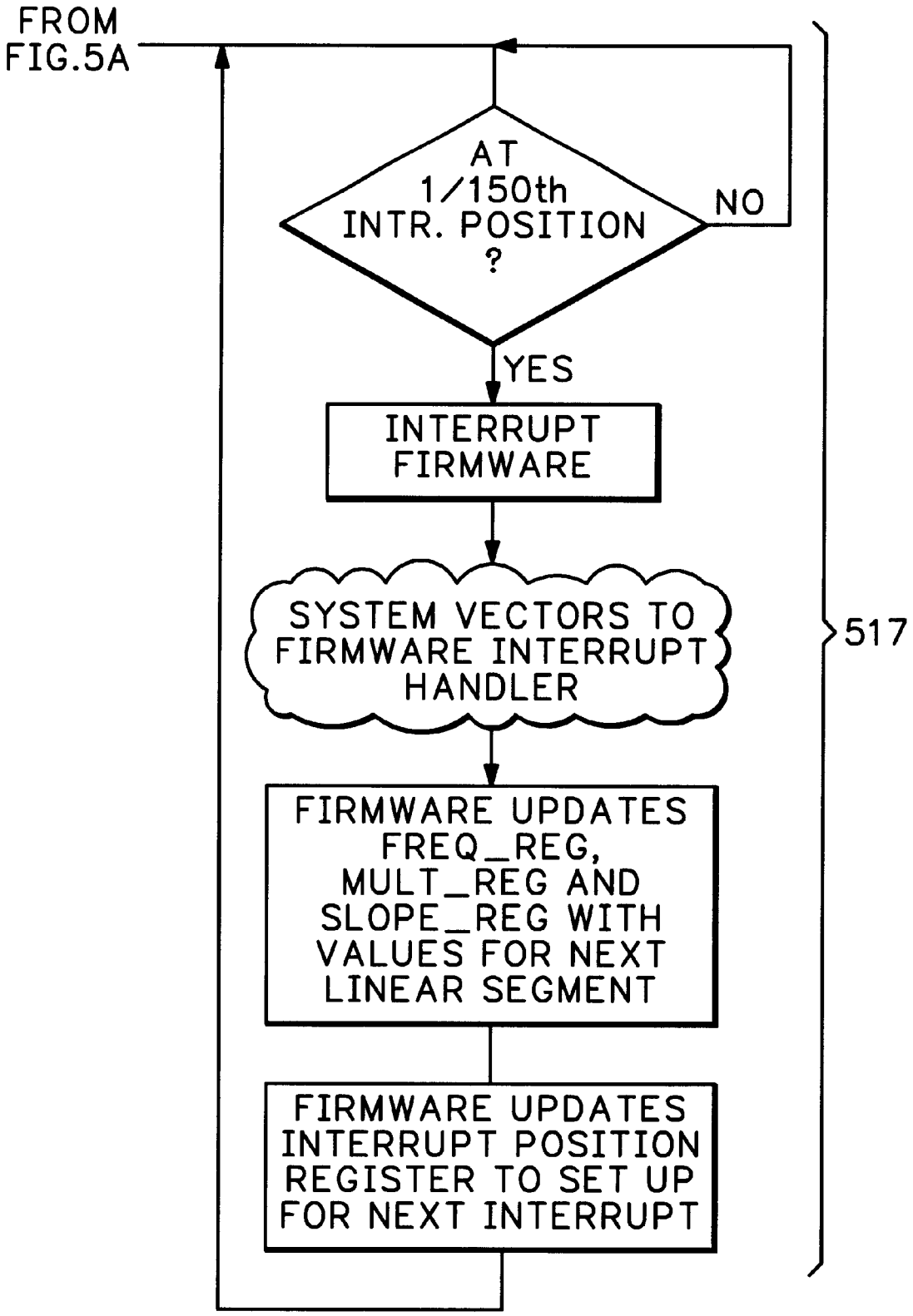

Before the start of a carriage sweep, all registers of the paper shape compensator 400 are initialized, step 501, FIG. 5. Paper shape, i.e., linear approximation segment slope and sign, parameters are then updated on Carriage_Position_Interrupts, "ExtPos," that is, whenever the carriage passes a pre-programmed 1/150th inch position along the x-axis. Firmware selects the 1/150th-inch position of the ExtPos interrupt by writing the Position into an Interrupt Position register 230. A comparator 231 generates an interrupt when that position is reached., Scanning_Position_Interrupt. In FIG. 3, ExtPos corresponds to Position, which changes at every Edge, viz. 1/150th- inch. Thus ExtPos changes at every FTP_Count. Any number of linear segments can be used. Four parameters are maintained in respective registers: Freq_Reg 401, Mult_Reg 402, Slope_Reg 403, and Flight_Time_Reg 203 (preferably, the first three registers 401, 402, 403 are actually coded into a single register to minimize system delay), FIG. 4. When the first three registers 401, 402, 403 are first set, the Expected_Flight_Time value for the start of the print zone is set in the Flight_Time_Reg 203. Thus, the decision to perform changes and the actual changes are made as the carriage 209 passes each 1/150-inch position during a scan of the x-axis after the print zone is entered.

The Freq_Reg 401 determines how often the Flight_Time_Register 203 is updated once the Print-Zone has been entered, step 503. When the carriage 209 is passed either edge of the Print-Zone, a frequency decrementer, Freq_Dec, 405 is loaded with the with content of the Freq_Reg 401, step 505. In the Print-zone, steps 507, the value is decremented at every 1/150th inch until it reaches zero, triggering the next stage. Note that when the Freq_Dec 405 reaches zero it also causes itself to be reloaded with the value of Freq_Reg 405 again to start timing for the next update, step 509.

The Mult_Reg 402 stage determines how much to change the flight time parameter in the Flight_Time_Reg 203. When triggered by the preceding Freq_Reg 401 logic stage, the value of Mult_Reg 402 is loaded, step 511, into a decrementer, Mult_Dec, 407. The Mult_Dec 407 counts down to zero and stays there until the next trigger from the Freq_Dec 405, step 513. For each non-zero count of the Mult_Dec 407 (step 513-No path), the value of the Flight_Time_Reg 203 is changed by a count of 1, steps 515. The plus or minus determination for incrementing or decrementing the Flight_Time_Reg 203 is provided by the value programmed in the Slope_Reg 403. The Slope_Reg 403 provides a value based on a measurement taken of the distance between a sensor and the paper. The values programmed in the Freq_Reg 401, the Mult_Reg 402, and the Slope_Reg 403 are based on mechanism mesurements taken of the distance sensed. [A variety of devices and techniques for the measurement of distance are known in the art. U.S. Pat. Nos. 5,262,797 and 5,289,208 and 5,414,453 and 5,448,269 include exemplary methods and apparatus assigned to the common assignee of the present invention and are incorporated herein by reference. In the present best mode, an actual paper shape profile along the x-axis is generated using test patterns as in the patents cited immediately above. This profiling can be accomplished during product testing during manufacture or, in a programmable implementation by providing each hard copy apparatus with a test mode capability whereby the end-user can generate a profile for the particular print media to be used (e.g., plain paper, photographic quality paper, transparencies, and the like) prior to an actual print job. In a more complex implementation, real time pen-to-paper distance sensing can be used during a scan. Such techniques are all known in the art and within the scope of the present invention paper shape compensation method and apparatus. It will be recognized by a person skilled in the art that a further description of such systems here is not essential to an understanding of the method and apparatus of the present invention.]

The number and position of the carriage position Interrupts is determined by the firmware programming employed for a specific implementation. In a properly designed system, these Interrupts will occur wherever there is a change in the linear approximation of paper shape. Thus, the foregoing process loops continuously until the Print-Zone is exited at which time the update process halts and the firmware can initialize the parameters for the next scan along the x-axis, shown generically as steps 517. The Flight_Time_Register 203 is potentially updated on any carriage Position (FIG. 3) and additionally enables a Carriage_Position_Interrupt such that it can be notified when the Freq_Reg 401, Mult_Reg 402, and Slope_Reg 403 parameters can be updated to approximate the next paper shape segment.

Note that the described system can be designed alternatively to run without the firmware intervention, but this would require a stack of Interrupt Position and paper shape registers having a stack height to equal the number of linear approximation segments desired. This would require more hardware and would be less flexible.

Carriage Velocity Compensation

Figure 1A:
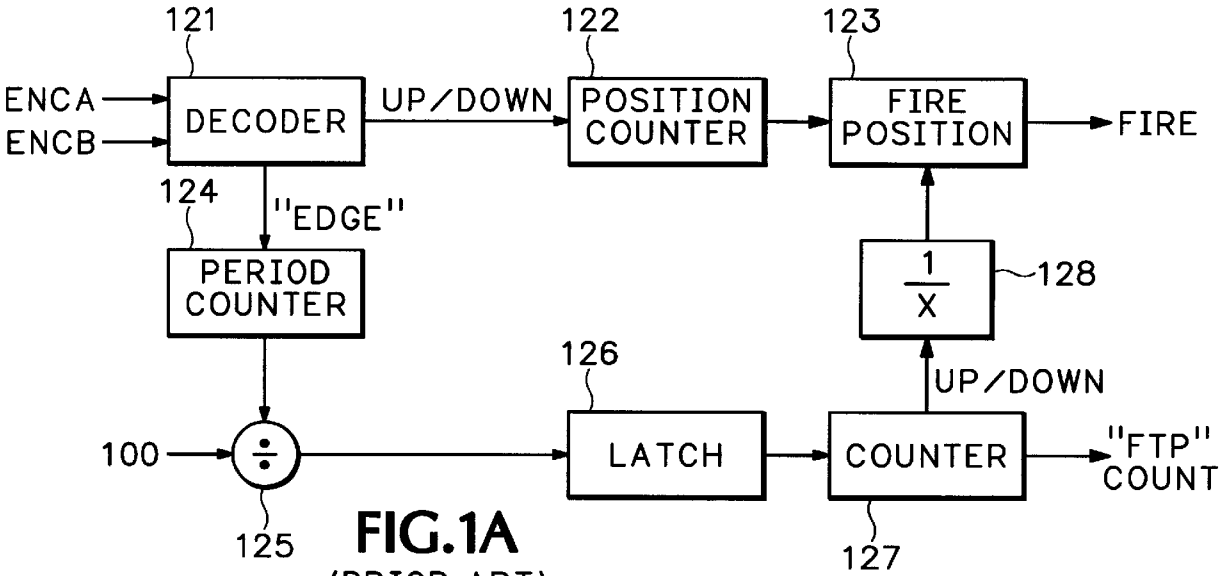
FIG.1A (PRIOR ART)
FIG. 1A (Prior Art) is a circuit block diagram for an ink drop firing encoder.
Figure 1B:
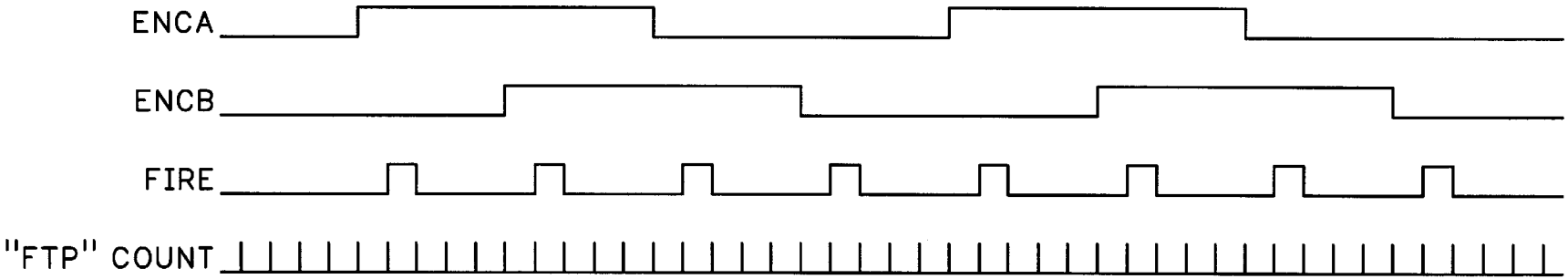
FIG.1B (PRIOR ART)
FIG. 1B (Prior Art) is a timing diagram for FIG. 1A.

Generally, as in the prior art such as in FIG. 1A, the velocity of the pen during scanning is measured by counting clock pulses between encoder edges. The desired spacing of the output ink drops is known based on the resolution of the printer, e.g., 300 DPI, 600 DPI, 750 DPI, et seq. Conceptually, the timing of the drop firing is calculated by dividing the drop spacing by the measured pen velocity:

$$t_{drop}=\text{DPI}\div v_{pen} \quad \text{(Equation 1).}$$

In practice, the known encoder spacing is divided by the known drop spacing to lead the same result:

$$EEPD=\text{encoder edge signals/inch}\div DPI \quad \text{(Equation 2).}$$

The inverse gives the number of drop spacings between encoder edges.

$$1/EEPD=\text{drops/encoder edge signal}=DPEE \quad \text{(Equation 3).}$$

The measured time between encoder edges, $t_{EE}$, is divided by this value which give the time between dot positions.

$$t_{drop}=t_{EE}\div DPEE \quad \text{(Equation 4).}$$

Thus, this value is used to count out drop positions.

The present invention leverages the prior art calculations by dividing the flight time, $t_{fly}$ of the drop by the calculated time between drop positions, $t_{drop}$. The resultant value represent the number of dot timings by which the current drop firing positions should be backed up to have the drops reach the paper surface at a desired encoder position rather than over-shooting the position:

$$N\ t_{drop}=t_{fly}\div t_{drop} \quad \text{(Equation 5).}$$

This value can also be thought of as a velocity compensation value since the effect is to advance the drop firing by the expected flight time.

As the nozzles on the pen's printhead are actually staggered, fire timing velocity compensation is calculated using the stagger distance. In state of the art printheads, there are typically twenty stagger steps between printed output columns; the calculated flight time correction value can correct a drop position to within a significant fraction of a dot width. Fractional values of the calculation thus can be discarded with no impact on print quality.

Turning back to FIG. 2, the Flight_Time_Reg 203 is shown and is, again, receiving an Expected_Flight_Time signal at the start of each period, in this exemplary embodiment each time the carriage 209 has moved 1/150th inch. This input is then used to extrapolate and predetermine a Flight_Time_Error which is equivalent to the number of FTP_COUNT pulses that a fired drop will travel along the scan axis from the time it is fired until it strikes the paper. Hence, it is also the advance time of firing required to compensate for pen-to-paper distance fluctuations as well as the actual carriage velocity.

Referring to FIG. 2, as in the prior art (compare FIG. 1A), the encoder signals, EncA and EncB, are input to a decoder 201; a Position Counter 205 keeps track of position in the x-axis and the Edge pulse is again used to with a Period Counter 207, extrapolation divider, "EXTRAP_DIV," 209, latch 211, counter 213, and register 215 to derive the actual carriage velocity and an Extrapolated_Position pulse stream, "ExtPos." In the preferred embodiment, the speed of the carriage is thus determined by measuring the number of clock cycles between each encoder edge; four separate counters are used with one each assigned to one encoder edge (EncA rise, EncA fall, EncB rise, EncB fall). When the edge occurs, the counter is reset to a start value of 0001 and the previous value is saved; the counter counts up until the next occurrence of that edge when its count is then saved. The outputs of all four period counters are added to form a continuous running average and the average saved in the Period Counter 207 during every time event. EncA and EncB "EDGE" sequence also indicates whether the current printing is occurring left-to-right or right-to-left.

In the prior art, ExtPos is simply used directly as the current position to determine when a stagged group of nozzles starts to fire in accordance with the FTP pulses. In accordance with the present invention, it is further extrapolated and corrected by the Flight_Time_Error to provide advanced firing. In other words, in the prior art the carriage motion produces firing signals that occur when the carriage has reached an indicated position. The Flight_Time-Register 203 value and its division 217 by a calculated "STAGGER_TIME"—where stagger is known for the particular printhead implementation—produces the Flight_Time_Error that is latched 219 and used in incrementing 221 the Fire Position counter 223 such that the output thereof provides a signal, "ColumnSync," used in combination with the Fire Timing Pulses at a programmable time before the carriage reaches the indicated position. In essence, the Flight_Time_Error value is the number of printhead nozzle address times that the ink drop will travel along the x-axis from the actual moment of firing to the time it strikes the adjacent print medium. The Flight_Time_Error is also thus a velocity compensation value as encoder edge pulses are substantially instantaneously extrapolated during each scan sweep regardless of velocity fluctuations and carriage acceleration/deceleration zones at each side of the print zone.

It will be recognized by a person skilled in the art that the Expected_Flight_Time input written to the Flight_Time_Register 203 can be an average drop flight time as measure in system clocks rather than as calculated in accordance with the circuit and method disclosed in FIGS. 4–6. Thus, in a printer 101 which essentially guarantees that the print media is truly flat, the paper shape compensation logic can be bypassed in favor of a simpler predetermined, preprogrammed flight time constant.

For bidirectional printing, the Flight_Time_Error value is added to the fire position register when the carriage is printing in a first direction, e.g., left to right on the first swath scan, and is subtracted to the fire position register when the carriage is printing in a second direction, e.g., right to left scan.

Note also that as a dynamic system, compensation is automatically adjusted during velocity acceleration and deceleration ramps at each end of the Print-Zone.

Figure 7:
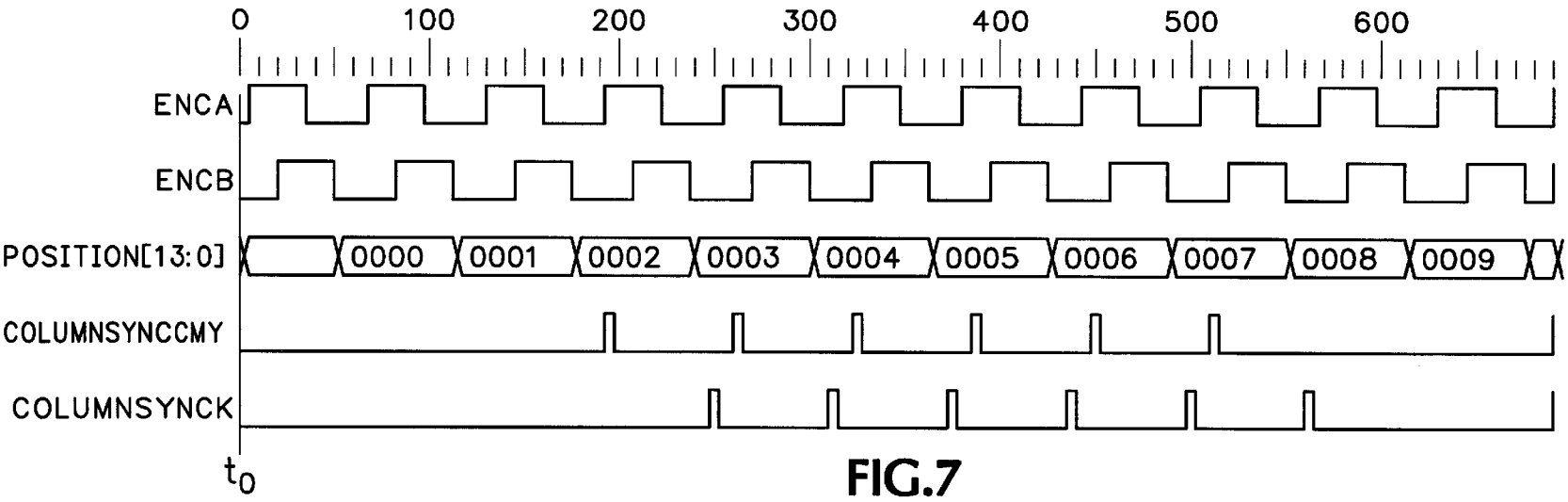
FIG. 7 is a timing waveform diagram comparing uncompensated and compensated fire timing pulses for a printhead scanning speed of 105 inches per second ("ips") in accordance with the present invention as shown in FIG. 2.
Figure 8:
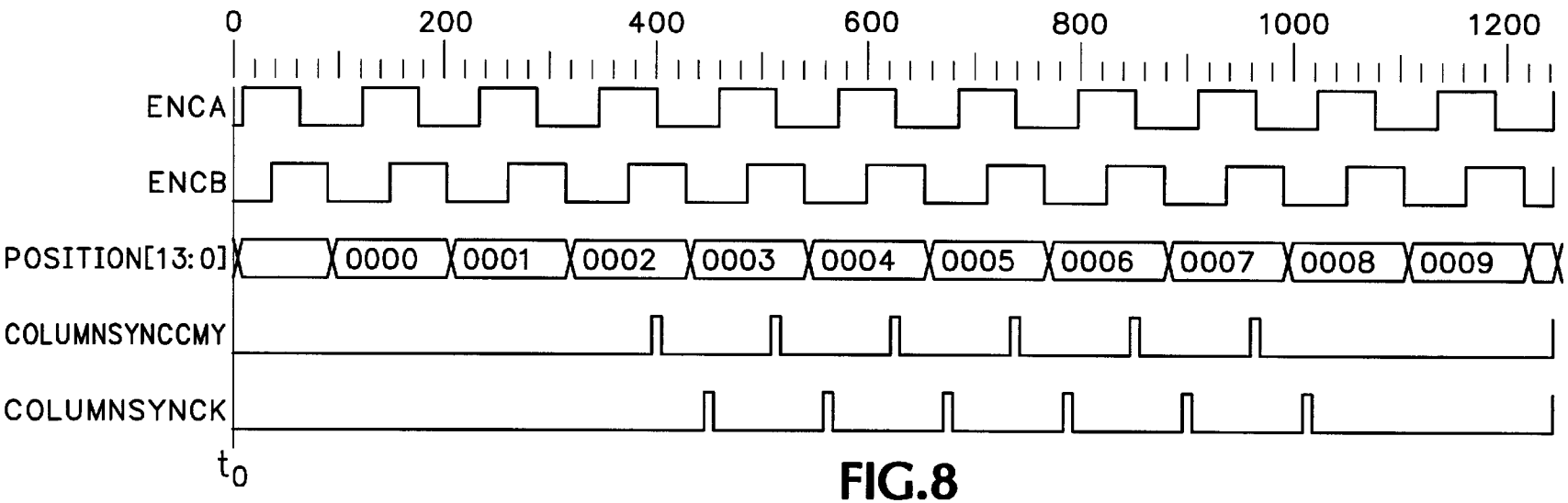
FIG. 8 is a timing waveform diagram comparing uncompensated and compensated fire timing pulses for a printhead scanning speed of 60 ips in accordance with the present invention as shown in FIG. 2.

FIGS. 7 and 8 are exemplary plots showing the effect of the use of Flight_Time_Error compensation. FIG. 7 is for a print speed of 107-ips and FIG. 8 is for a print speed of 60-ips. In both plots, ColumnSyncK shows where the printhead firing pulse occurs without compensation; ColumnSyncCMY shows where the printer fire with a determined 50-microsecond compensation based on the programmed value in the Flight_Time_Register 203.

The system as explained hereinabove compensates for the time that it takes each fired drop to reach the paper, compensating for variations in pen-to-paper distance and carriage velocity changes. As the flight time compensator takes the current carriage position at, e.g., 1/150th inch and combines it with the extrapolated position between the 1/150ths of position 00 through EXTRAP_DIV minus one (see FIG. 3 where EXTRAP_DIV=99), the estimated current carriage position is accurate to one pen address time, or stagger. The ink drop thus hits the intended target pixel without any substantial offset.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. An ink drop fire timing control method for an ink-jet hard copy means for producing dot matrix printing on target pixels of a print media, said hard copy means including an ink-jet pen having a printhead with a plurality of ink drop firing nozzles arranged as a staggered vertical column, a carriage for scanning the pen across print media along a linear horizontal axis, and means for generating periodic carriage position signals representative of periodic predetermined pen scanning positions along said axis as said carriage is scanning the pen across print media along a linear axis, the method comprising:

providing a signal indicative of coarse position of said carriage during scanning;

from said signal indicative of coarse position, deriving a periodic ink drop firing time signal;

from said signal indicative of coarse position, extrapolating a signal indicative of fine position of said carriage during scanning, said fine position being a predetermined subdivision of said coarse position, wherein the value of said predetermined subdivision is at least equal to the number of ink drop firing nozzles;

providing a signal indicative of expected flight time of a drop from said printhead to said print media;

from said signal indicative of fine position and said signal indicative of expected flight time, deriving a flight time error signal; and from said flight time error signal, advancing said periodic ink drop firing time signal such that ink drops are fired before said carriage is positioned over a target pixel, wherein providing a signal indicative of expected flight time of a drop from said printhead to said print media includes programming a paper profile value for each said fine position, and incrementing said expected flight time when said profile value indicates pen-to-paper spacing is increasing at a fine position along said axis and decrementing said expected flight time when said profile indicated pen-to-paper spacing is decreasing at a fine position along said axis.

2. An ink drop fire timing control device for an ink-jet hard copy means for producing dot matrix printing on print media, said hard copy means including an ink-jet pen, a carriage for scanning the pen across print media along a linear axis, and means for generating periodic predetermined carriage position signals representative of periodic predetermined pen scanning positions along said axis as said carriage is scanning the pen across print media along a linear axis, the device comprising:

paper shape compensation means for generating a value representative of expected flight time for each of said periodic predetermined pen scanning positions along said axis calculated from a predetermined paper shape profile; and means for adjusting ink drop fire timing based on said value representative of expected flight time such that ink drops are ejected from said pen before said carriage positions said pen at a position for firing based on said signal representative of periodic predetermined pen scanning positions along said axis, said means for adjusting including a divider for calculating a number, the number being used to determine periodic, predetermined pen scanning positions where ink drop fire timing is to be advanced by dividing expected flight time by a calculated time between drop positions.

3. The device as set forth in claim 2, comprising:

said calculated time is nozzle stagger distance divided by carriage velocity.

4. The device as set forth in claim 1, wherein said means for adjusting further comprises:

means for correcting fire timing advance for bidirectional printing.

5. An ink drop fire timing control device for an ink-jet hard copy means for producing dot matrix printing on print media, said hard copy means including an ink-jet pen and a carriage for scanning the pen across print media along a linear axis, and, the device comprising:

means for generating periodic carriage position signals as said carriage is scanning the pen across print media along a linear axis;

connected to said means for generating periodic carriage position signals, means for producing ink drop fire timing signals based upon the periodic carriage position signals; and connected to said means for producing ink drop fire timing signals, flight compensation means for extrapolating a value representative of expected ink drop flight time error from the pen to the print media and advancing said ink drop fire timing signals to compensate for said expected ink drop flight time error such that ink drop flight time is compensated for velocity changes of the carriage as the carriage traverses the linear axis, the compensating means including a divider for calculating a number, the number being used to determine periodic, predetermined pen scanning positions, where ink drop fire timing is to be advanced, by dividing expected flight time by a calculated time between drop positions, wherein scanning position interrupt signals are generated by comparing carriage position with a next predetermined interrupt position.

6. The device as set forth in claim 5, wherein means for producing ink drop fire timing signals also comprises:

means for generating ink-jet pen scanning position timing signals at periodic predetermined pen scanning positions along said axis.

7. The device as set forth in claim 6, wherein means for generating ink-jet pen scanning position timing signals at periodic predetermined pen scanning positions along said axis comprises:

means for generating timing signals for each nozzle in a column of nozzles of said pen.

8. The device as set forth in claim 6, wherein said flight compensation means also comprises:

means for dynamically adjusting the advancing of said ink drop fire position signals by an amount that is a multiple of said timing signals.

9. The device as set forth in claim 5, wherein said flight compensation means also comprises:

means for advancing said ink drop fire timing such that fired ink drops hit target pixel addresses within a margin of error of approximately one stagger distance.

10. The device as set forth in claim 6, wherein said flight compensation means further comprises:

paper shape compensation means for generating a value representative of expected flight time for each of said periodic predetermined pen scanning positions along said axis.

11. The device as set forth in claim 10, where said paper shape compensation means further comprises:

re-loadable down counter means for counting at each of said periodic predetermined pen scanning positions along said axis; and connected to said counter means, means for changing said value representative of expected flight time such that said value representative of expected flight time is incremented when pen-to-paper spacing is increasing and decremented when pen-to-paper spacing is decreasing at each of said periodic predetermined pen scanning positions along said axis.

12. An ink-jet paper shape compensation device for generating a value representative of expected flight time for each of said periodic predetermined pen scanning positions along said axis, comprising:

re-loadable down counter means for counting at each of said periodic predetermined pen scanning positions along said axis; and connected to said counter means, means for changing said value representative of expected flight time such that said value representative of expected flight time is incremented when pen-to-paper spacing is increasing and decremented when pen-to-paper spacing is decreasing at each of said periodic predetermined pen scanning positions along said axis, said means for changing including a divider for calculating a number equivalent to said periodic predetermined pen scanning positions where pen nozzle fire timing is advanced by dividing expected flight time by a calculated time between drop firing positions.

* * * * *